United States Patent [19]

O'Connor, III et al.

[11] 4,360,064

[45] Nov. 23, 1982

[54] CIRCULATING VALVE FOR WELLS

[75] Inventors: John A. O'Connor, III; Warren E. Holland; James D. Burley; Ronald D. Rogers; Fred E. Watkins; Ben D. Terral, all of Harris County, Tex.

[73] Assignee: Exxon Production Research Co., Houston, Tex.

[21] Appl. No.: 206,220

[22] Filed: Nov. 12, 1980

[51] Int. Cl.[3] ..... E21B 34/08; E21B 34/10

[52] U.S. Cl. ..... 166/319; 166/325

[58] Field of Search ..... 137/540, 514.17, 514.2; 166/117.5, 325, 184, 131, 350

[56] References Cited

U.S. PATENT DOCUMENTS

| | | | |
|---|---|---|---|
| 2,828,698 | 4/1958 | Bryan | 166/117.5 |
| 2,856,008 | 10/1958 | Spencer | 166/117.5 |
| 2,919,709 | 1/1960 | Schwegman | 166/325 X |
| 3,370,008 | 11/1973 | Turney | 137/540 |
| 3,958,633 | 5/1976 | Britch | 166/117.5 |
| 3,994,339 | 11/1976 | Goode | 166/117.5 |
| 4,006,128 | 1/1978 | Davis et al. | 166/117.5 X |
| 4,201,265 | 5/1980 | Thomason et al. | 166/117.5 |
| 4,239,082 | 12/1980 | Terral | 166/117.5 |
| 4,260,020 | 4/1981 | Nelson et al. | 166/325 X |

*Primary Examiner*—Stephen J. Novosad

*Assistant Examiner*—Joseph Falk

*Attorney, Agent, or Firm*—John S. Schneider

[57] ABSTRACT

A circulating (kill) valve for hot, high pressure wells includes a valve assembly to be positioned in an open-ended tubular-shaped side-pocket housing of a mandrel connected into a well tubing string. The valve assembly includes an open-ended cylindrical valve body provided with an interior sealing seat and spaced-apart side openings. A valve element is arranged within the valve body and is urged by unbalanced pressures to the open or closed position depending on the direction of the pressure imbalance. In the closed position a sealing surface on the exterior of the valve element engages and seals with the lower interior sealing seat of the valve body. A ported access to the inner well string pressure permits that pressure to urge the valve element to the closed position. Such pressure may be overcome by pressure imbalance when fluid pressure exterior of the tubing string forces the valve element upwardly from its seat. A wiper seal is arranged on the interior of the valve body and engages the outer surface of the valve element. A ported access to inner tube pressure urges the valve element to the closed position which may be overcome by pressure imbalance when exterior pressure forces the valve element from its seat.

10 Claims, 9 Drawing Figures

FIG. 1.
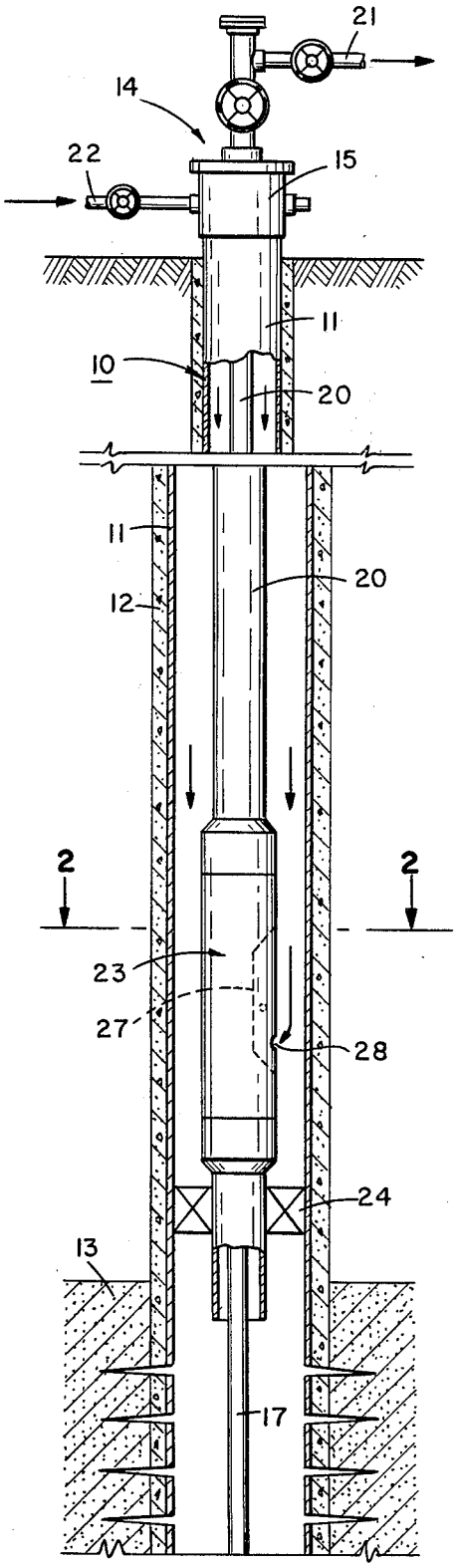
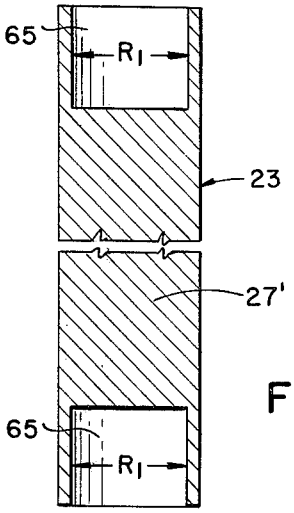
FIG. 8.
FIG. 9.
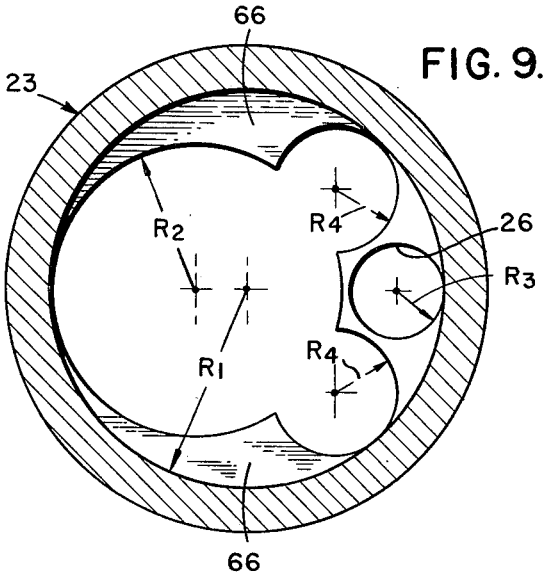
FIG. 2.
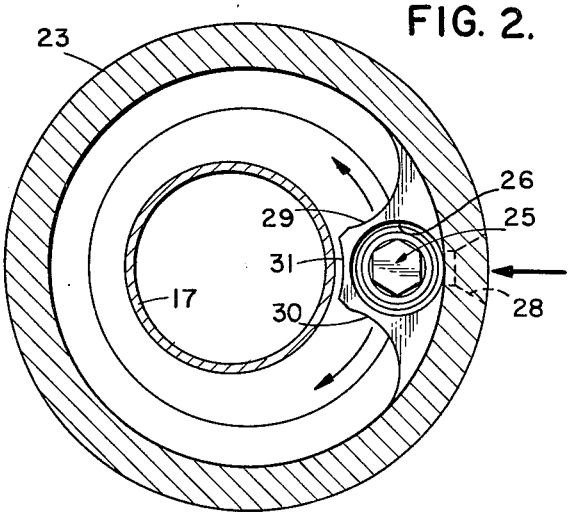

CIRCULATING VALVE FOR WELLS

BACKGROUND OF THE INVENTION

This invention relates to well tools and, particularly, to a flow control apparatus and a mandrel support for such apparatus of the side-pocket type for use in a well pipe or tubing.

Various pressure control techniques for high pressure wells utilize a circulating (kill) valve near the bottom of a tubing string that permits heavy drill weight and light completion weight fluids to be displaced from the tubing-casing annulus and tubing flow conduit after a packer sealing and tubing-casing annulus has been set. The circulating valve must close and remain pressure sealed after pumping operations are complete and be capable of reopening when necessary for additional well control fluid circulation operations. The failures of available circulating (kill) valves are aggravated by opening and closing manipulating operations, metal erosion caused by the circulating fluids, and high temperature and well environmental effects on nonmetallic valve sealing components.

The present invention provides an improved pressure operated downhole circulating (kill) valve which alleviates the primary causes of problems with that type valve. This circulating valve is not only useful in downhole circulating well-kill operations, it also has use as a chemical injector valve and in other well operations where it is desired to circulate fluid between well pipes.

SUMMARY OF THE INVENTION

Apparatus for controlling flow of fluids in wells comprises a valve assembly to be positioned in a tubular-shaped side-pocket housing of a mandrel connected into a tubing string. The housing is open to the interior of the mandrel at one end and to the exterior of the mandrel at the other end. In between, the housing opens to the interior of the mandrel through radially spaced-apart ports or openings. The valve assembly includes a cylindrical valve body having an interior metallic seating shoulder, a metallic exterior sealing surface, first openings fluidly communicating with the interior of the mandrel, second openings aligned with the radially spaced-apart openings in the housing, such second openings being located so as to direct exiting fluid therethrough in circumferential directions toward the interior wall surface of the mandrel, and a threaded exterior portion for engaging a threaded portion of the interior of the housing; a metallic valve element movable between open and closed positions, the valve element when in the closed position sealingly engaging the interior metal sealing shoulder of the valve body and when in the open position permitting flow of fluid through the radially spaced-apart openings to the exterior of the housing; and a wiper seal ring arranged on the interior of the valve body engaging the outer surface of the valve element. The seal ring loosely engages the outer surface of the valve element when the valve element is in its closed position and seals more tightly against the outer surface of the valve element when the valve element is in its open position. The purpose of the seal is to wipe the valve element free of debris and to provide a pressure differential while the valve element is in the open position to urge the valve element fully open or closed. Pressure differential across the seal ring alone may be employed to move the valve element to its closed position or a compression spring may be employed which together with pressure differential across the seal ring moves the valve element to its closed position, or the spring force alone may be used to move the valve element to its closed position. A seal may be positioned on the valve body to seal off the annulus between the interior of the housing and the exterior of the valve body and between the first openings in the valve body and the threads on the valve body. The exterior metallic sealing surface engages a tapred metallic seating surface on the interior surface of the housing.

BRIEF DESCRIPTION OF THE DRAWINGS

FIG. 1 is a view of the circulating valve/mandrel arranged in a well bore;

FIG. 2 is a view taken on line 2—2 of FIG. 1;

FIGS. 8 and 9 illustrate one manner for forming the mandrel and sidepocket housing thereof.

DESCRIPTION OF THE PREFERRED EMBODIMENT

Figure 3:
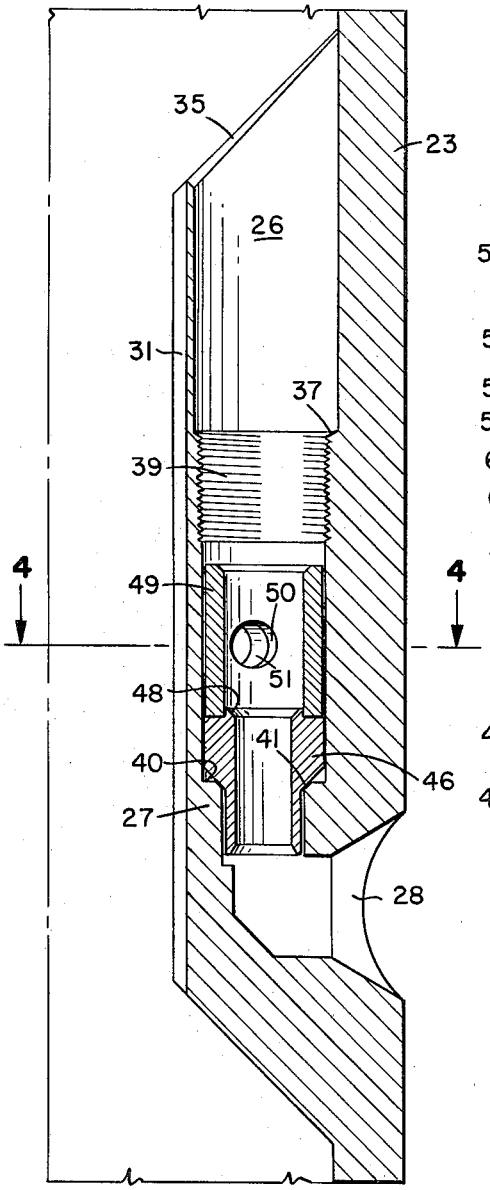
FIG. 3 is a view, partly in section, of the side-pocket housing of the mandrel in which portions of the circulating valve assembly are positioned.
Figure 5:
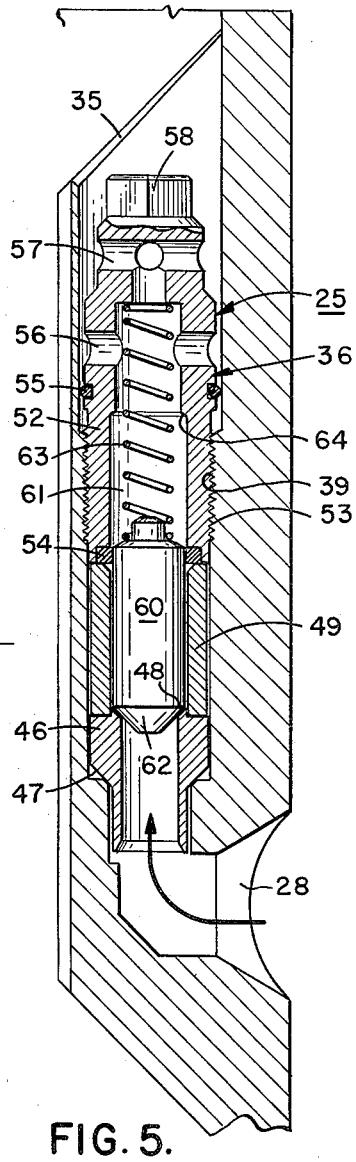
FIGS. 5 and 6 are views similar to that of FIG. 3 showing, respectively, the circulating valve assembly in closed and open positions.

In FIGS. 1 and 2 there is shown a well 10 in which a casing 11 has been cemented, as indicated at 12, and perforated in a producing interval, as indicated at 13. At the surface a Christmas tree 14 is mounted on a wellhead 15 on the top of casing 11. A tubing/well pipe string 20 is suspended from wellhead 15. A valved conduit 21 is connected to the upper end of tubing string 20 and a valved conduit 22 is connected into wellhead 15. A mandrel 23 is connected into tubing string 20 above a packer 24 which closes off the annulus between casing 11 and tubing string 20. Concentric tubing 17 may be suspended from the Christmas tree 14 to extend through the lower end of tubing string 20, as shown. As also shown, a valve assembly 25 is positioned in the bore 26 of a side-pocket housing 27 in mandrel 23. An opening 28 in mandrel 23 connects into the lower end of bore 26 of the housing. The housing may have curved side surfaces, indicated at 29 and 30, and a lesser curved surface 31 therebetween.

Figure 6:
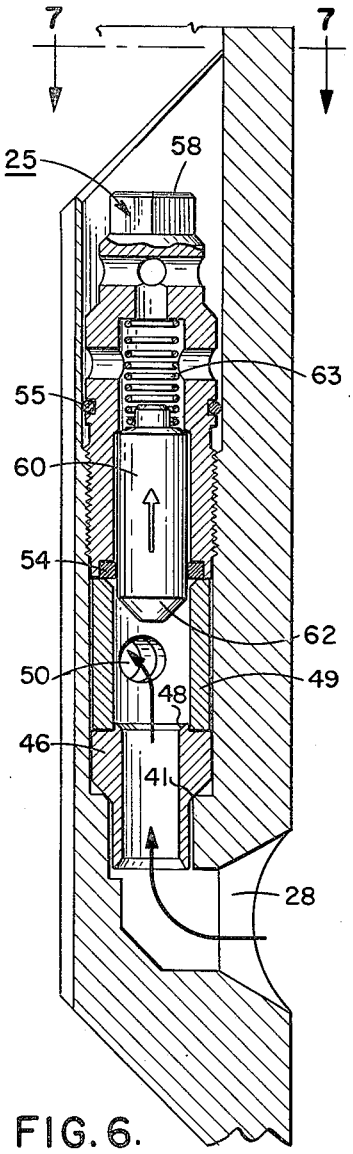

Side-pocket housing 27 and valve assembly 25 are shown in greater detail in FIGS. 3 through 7. Referring to those Figs., the upper end of housing 27 has a slanted or tapered surface 35 which facilitates running pipe and other equipment through mandrel 23. The surface of bore 26 of housing 27 contains an upper shoulder 37 which forms a reduced cross-sectional area of bore 26. A portion of the surface of bore 26 is threaded, as indicated at 39, and a lower shoulder 40, having a tapered sealing surface edge 41, further reduces the cross-sectional area of bore 26. As seen more particularly in FIGS. 3, 5 and 6, valve assembly 25 includes a valve body generally designated 36, which in turn includes a cylindrical seat element 46 having an outer tapered metal forward sealing surface 47 which seats on metal surface 41, preferably a carbide surface, of housing 27. The upper interior edge of seat element 46 forms a tapered seating surface 48. Valve body 36 also includes a cylindrical sleeve 49 which contains outlet ports 50 aligned with ports 51 in housing 27 (see FIG. 4); and is supported on a recess formed in the upper end of seat element 46 surrounding surface 48; a cylindrical valve element 52, having a threaded portion 53, threaded into threads 39 of housing 27, a wiper seal ring 54 positoned in a recess on the lower end of valve element 52 engages the upper end of sleeve 49; an O-ring 55 arranged on valve element 52 above threads 53 and below side ports 56; and additional ports 57 formed in valved element 52 below a nut head 58. Valve assembly 25 also includes a valve stem or dart 60 located within a chamber, indicated at 61, of valve body 36 having a sealing surface 62 for sealing on seating surface 48 of seat element 46 in the closed position of the valve assembly; and a compression spring 63 arranged in bore 61 to assist initiation of movement of dart 60 to such closed position. The inner surface of valve element 52 contains a stop shoulder 64 to limit upward movement of valve stem 60 as shown in FIG. 6, the open position of valve assembly 25.

Figure 4:
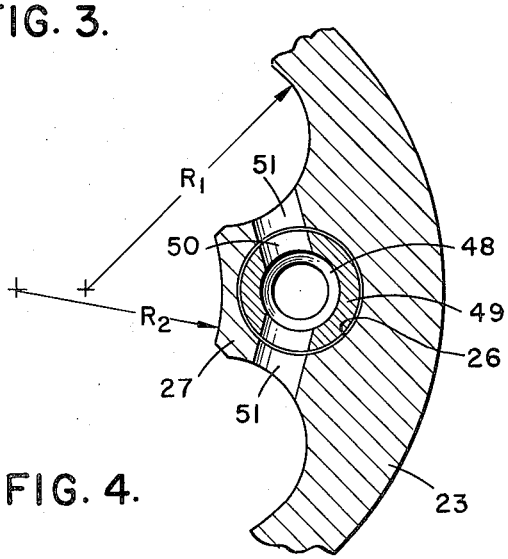
FIG. 4 is a view taken on line 4—4 of FIG. 3.
Figure 7:
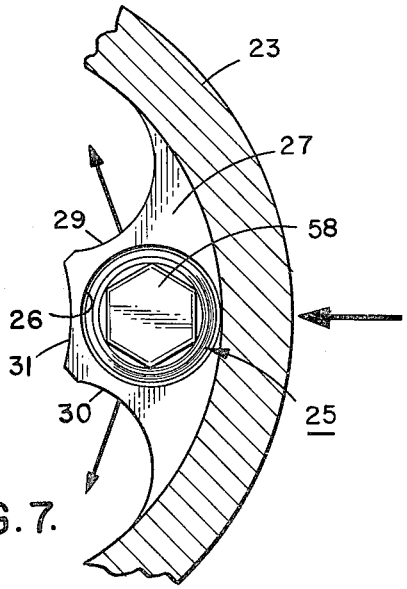
FIG. 7 is a view taken on line 7—7 of FIG. 6.

FIGS. 8 and 9 illustrate one manner of forming the mandrel 23 and side-pocket housing 25. As seen in FIG. 8 a hole 65 of radius $R_1$ is first drilled into each end of solid cylindrical member 23. The solid undrilled portion 27' of member 23 is about the length of side-pocket housing 27. Then a series of holes of radii $R_2$, $R_3$ and $R_4$ are drilled through the undrilled portion 27' of member 23. Bores 51 are then drilled between hole 26 and the holes of radii $R_4$ and opening 28 is formed to connect with hole 26. The remaining undrilled portion of member 23' indicated at 66 may be removed, as shown in FIG. 4 or, if desired, may be left in place.

Mandrel housing 27 provides an offset but large throughbore. The fluid exits, indicated by the arrowed lines in FIGS. 2 and 7, enables the valve to be used with concentric tubing 17 inside the bore of the mandrel without jetting or flow-cutting a hole in the tubing while circulating fluid through the valve. When annulus pressure is raised above tubing pressure, fluid from outside tubing string 20 is ported through the wall of mandrel 23. Fluid from the annulus between casing 11 and tubing string 20 enters housing 27 through inlet port 28 into an enlarged flow exit chamber. Flow is directed from the exit chamber section, also made from corrosion resistant material, by means of the slotted or ported windows 50 and 51. Such windows control the direction of exiting fluid flow and pressure drop through valve assembly 25. Flow through the valve assembly is accomplished with sufficient pressure drop across the upper seal 55 to cause the sealing valve element or dart 60 to move completely off its seat and overcome the slight opposing force of spring 63. During circulation, dart 60 is forced against the light spring compression to permit fluid passage through ports 50 and 51. In this condition dart 60 may move to full engagement with shoulder 64 as shown in FIG. 6 where it is removed from the active flow stream and protected from fluid erosion. Valve closure is accomplished by increasing pressure in tubing string 20 to increase pressure inside valve assembly 25. When the inside pressure in tubing string 20 exceeds pressure outside valve assembly 25, dart 60 is returned to its initial closed position. Surface 62 is then in metal-to-metal sealing contact with seating surface 48. Fluid flow through the slightly reduced seat area does not impinge on the sealing surfaces during opening and closing action of the valve assembly. Pressure differential to assist full opening of sealing dart 60 is created by porting to tubing string 20 through openings 56 and 57 at the top of chamber 61. The force of spring 63 may be used alone to cause dart 60 to move from its open to its closed position. Or, spring 63 may assist the small differential pressure across the wiper ring 54 in urging the sealing dart 60 from the full open to the closed position. Or, spring 63 may be omitted entirely and the differential pressure across wiper ring 54 alone may be used to urge the sealing dart 60 from the full open to the closed position. Wiper ring 54 always remains in contact with the external surface of dart 60. That ring serves to wipe the dart clean and avoids sticking caused by solid particles in the fluids circulated. When dart 60 is in the open or unsealed position of the valve, wiper ring 54 deforms and seals more completely against the external surface of dart 60 under the differential fluid pressure across wiper ring 54. Once surface 62 of dart 60 is in sealing contact with sealing surface 48, there is no pressure differential across wiper ring 54 and the wiper ring more loosely engages the outer surface of dart 60.

The chamber-type opening 28 is designed to minimize velocity of flow to avoid turbulence at the opening and, thereby, minimize erosion and corrosion effects. The tapered opening at 28 also minimizes cutting as the flow direction of the fluid in the annulus changes direction.

Spring 63 is not required to cause dart 60 to move to the closed position or to seal. Differential pressure across wiper ring 54 alone may be used to move the dart from its fully open to its closed position. However, it may be desirable to use the spring force by itself to move the dart from its fully open to its closed position or at least to assist differential pressure forces across the wiper ring to move the dart from its fully open to its closed position. One advantage in having the spring is to insure that the dart does not become hung up because of some obstruction when it is desired to have the dart move towards its closed position.

The above description of the invention is explanatory only and changes in the details of the apparatus described and illustrated may be made by those skilled in the art within the spirit of the appended claims without departing from the invention. In the description of the preferred embodiment of the invention the terms "upper" and "lower" are used to devote one end of the valve from the other. It is to be understood, however, that this valve is independent of gravity or positional orientation and may be used as shown, or inverted, or horizontally, or in any orientation without alteration.

We claim:

1. Apparatus for controlling the flow of fluids in wells comprising:

a valve assembly capable of being positioned in a tubular shaped side-pocket housing of a mandrel connected into a tubing string including;

a cylindrical valve body having an interior seal shoulder and first openings capable of communicating with the interior of said mandrel and second radially spaced-apart openings alignable with radially spaced-apart openings in said housing and a threaded exterior for theadly connecting said body to the interior surface of said housing;

a valve element movable from closed to open positions and vice versa, said valve element having a sealing surface engageable with said sealing surface of said valve body when in said closed position in said valve element permitting flow of fluids through said second openings and being completely out of the flow path of said fluids when in said open position; and a seal arranged on the interior of said valve body engaging the outer surface of said valve element for wiping said valve element and for providing a pressure differential while said valve element is in the open position to urge said valve element fully open or closed.

2. Apparatus as recited in claim 1 including spring means to move said valve element from the open to the closed position thereof.

3. Apparatus as recited in claims 1 or 2 in which said first openings communicate with the interior of said mandrel capable of coacting with said seal to permit access of fluid within said tubing string to drive said valve element to said closed position thereof.

4. Apparatus as recited in claim 1 including spring means to assist movement of said valve element to the closed position thereof.

5. Apparatus as recited in claim 1 in which said second openings are spaced-apart so as to cause flow of fluids exiting therethrough to flow circumferentially to the space between the interior wall of said mandrel and outer wall of an inner concentric tubing.

6. Apparatus as recited in claims 1 or 2 including seal means between the exterior of said valve body and the interior of said housing between said second openings and said threaded portion of said valve body.

7. Apparatus as recited in claims 1 or 2 including a metallic sealing surface on the exterior of said valve body engageable with a metallic sealing surface on the interior surface of said housing.

8. Apparatus as recited in claims 1 or 2 in which the end of said mandrel nearest said first openings is open and tapered.

9. Apparatus as recited in claims 1 or 2 in which said radially spaced openings on the exterior of said housing are positioned to facilitate the flow of said fluids toward the annular space between the wall of said mandrel and the wall of an inner concentric work pipe, said exterior surface between said ported surfaces being curved to accommodate said well pipe extending through said mandrel.

10. Apparatus as recited in claims 1 or 2 in which said sealing surface on said valve element is conically shaped.

* * * * *